US006259338B1

(12) United States Patent
Boeder et al.

(10) Patent No.: US 6,259,338 B1
(45) **Date of Patent: *Jul. 10, 2001**

(54) MULTIPOLE CIRCUIT BREAKER

(75) Inventors: Franz Boeder, Ahrbrueck; Guido Dedenbach, Bonn; Hans-Juergen Mader, Dieblich, all of (DE)

(73) Assignee: Moeller GmbH, Bonn (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/520,871

(22) Filed: Mar. 8, 2000

(30) Foreign Application Priority Data

Mar. 8, 1999 (DE) ..... 199 10 032

(51) Int. Cl.[7] ..... H01H 75/00; H01H 77/00; H01H 83/00; H01H 9/30

(52) U.S. Cl. ..... 335/6; 335/8; 335/201

(58) Field of Search ..... 335/6, 8–10, 201, 335/202; 200/50.32

(56) References Cited

U.S. PATENT DOCUMENTS 3,562,469 * 2/1971 Peck ..... 335/8
5,262,744 * 11/1993 Arnold et al. ..... 335/8
5,910,757 * 6/1999 Broghammer et al. ..... 335/9

FOREIGN PATENT DOCUMENTS 42 01 255 7/1992 (DE) .
0 542 636 10/1992 (EP) .
0 634 051 1/1995 (EP) .

* cited by examiner

*Primary Examiner*—Ramon M. Barrera
(74) *Attorney, Agent, or Firm*—Kenyon & Kenyon

(57) ABSTRACT

A multipole circuit breaker includes an arcing chamber housing with a number of arcing chambers, corresponding to the number of poles, arranged next to each other. Each arcing chamber has a hinged contact bridge cooperating with a stationary contact arrangement. An interrupter shaft common to the poles of the multipole circuit breaker and including a number of shaft segments made of an insulating material, in each of which a contact bridge is arranged, is provided. The adjoining shaft segments are joined to each other by a respective coupling element, each coupling element including two tab-shaped parts joined to each other by a support shaft. Each tab-shaped part supports at least two first connecting pins on a side facing away from the support shaft and extending in an axial direction. The shaft segments each include recesses a side facing the coupling element, the recesses for receiving the connecting pins. A support, or bearing, for supporting the support shaft is provided in the arcing chamber housing in a transition area between adjacent arcing chambers.

6 Claims, 2 Drawing Sheets

1
2
5
2
12
9
30
11
8
4
31
10
3
7
29
32
6

FIG.2
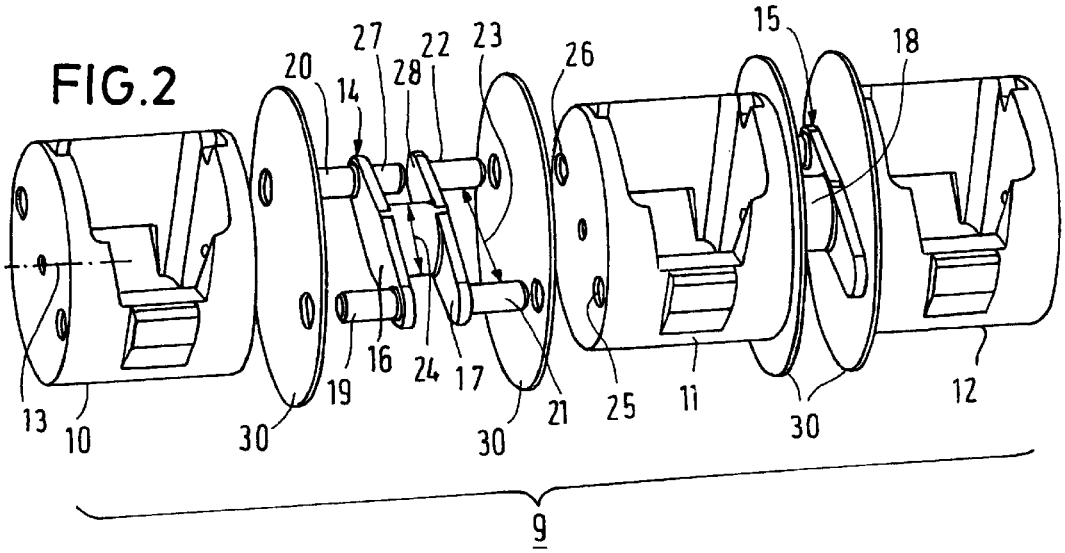
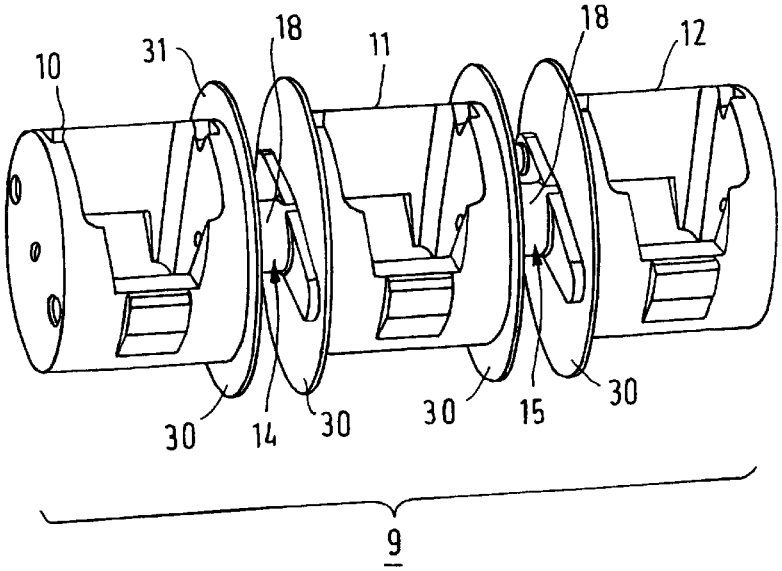
FIG.3

MULTIPOLE CIRCUIT BREAKER

FIELD OF THE INVENTION

The present invention relates to a multipole circuit breaker having an explosion, or arcing, chamber housing, in which a number of arcing chambers, corresponding to the number of poles, are arranged next to each other, and having an interrupter shaft that is in common for all poles, each arcing chamber having a stationary contact arrangement and a hinged contact bridge arrangement which cooperates with the stationary contact arrangement.

RELATED TECHNOLOGY

A multipole circuit breaker having an arcing chamber is known, for example, from European Patent Document No. 0542 636 B1. In this context, each of the contact bridges is arranged in a separate, plastic shaft segment of the interrupter shaft. To join the shaft segments, provision is made for two switch, or drive, rods, extending in the axial direction and arranged so as to be parallel to each other. In this known circuit breaker, it is disadvantageous that assembly of the interrupter shaft, composed of shaft segments and switch rods, is relatively time-consuming. In addition, an expensive bearing assembly for the interrupter shaft is required in the latching mechanism of the circuit breaker, and if continuous metal rods are used, problems often arise with respect to the electrical insulation of the adjoining explosion chambers. Finally, the torsional stiffness of an interrupter shaft of this type is slight and as a rule does not stand up to the demands placed on it.

From European Patent Document No. 0 634 051 B1, a multipole circuit breaker having an interrupter shaft in common for all poles is known, in which, as well, the contact bridges of the individual arcing chambers are arranged on shaft segments. To manufacture the interrupter shaft, the middle shaft segment at both of its ends has a central pin, which is inserted into corresponding recesses, or cavities, of the adjoining shaft segments. In addition, provision is made at the end of the shaft segments for levers having recesses that receive additional coupling pins. Disadvantageous in this known circuit breaker is the supplemental connection using coupling pins, as well as the also relatively expensive bearing assembly, to assure a precise positioning of the interrupter shaft.

Finally, from German Patent Document No. 42 01 255 A1, a multipole circuit breaker having one interrupter shaft in common for all poles is known, in which the contact bridges assigned to the explosion chambers are arranged in adjoining shaft segments. For the formation of the interrupter shaft, the shaft segments are joined to each other using plastic coupling elements. The coupling elements are each composed basically of a central intermediate wall for electrically insulating adjoining hinged contact bridges as well as of cylindrical parts, arranged on both sides of the intermediate wall, having each case two holding pins, which engage in corresponding recesses in the shaft segments. In this circuit breaker as well, the relatively expensive bearing assembly of the interrupter shaft, mainly in the area of the shaft segments, is disadvantageous.

SUMMARY OF THE INVENTION

An objective of the present invention is to provide a multipole circuit breaker whose interrupter shaft can be preassembled in a simple fashion, has sufficient torsional stiffness, and does not require an expensive bearing assembly in order to achieve a precise positioning in the arcing chamber housing.

The present invention provides a multipole circuit breaker including an arcing chamber housing defining a first and a second arcing chamber disposed next to each other and each corresponding to a respective pole of the multipole circuit breaker. An interrupter shaft common to the respective poles of the multipole circuit breaker is provided, the interrupter shaft defining an axial direction and including first and second shaft segments, the first and second shaft segments including an insulating material. A coupling element joining the first and second shaft segments is provided, the coupling element including first and second tab-shaped parts joined to each other by a support shaft, the first tab-shaped part supporting at least two first connecting pins on a first side facing away from the support shaft, the second tab-shaped part supporting at least two second connecting pins on a second side facing away from the support shaft, the first and second connecting pins extending in the axial direction. A first stationary contact arrangement and first hinged contact arrangement disposed in the first arcing chamber are provided, the first hinged contact arrangement cooperating with the first stationary contact arrangement and including a first hinged contact bridge disposed in the first shaft segment. A second stationary contact arrangement and second hinged contact arrangement disposed in the second arcing chamber are provided, the second hinged contact arrangement cooperating with the second stationary contact arrangement and including a second hinged contact bridge disposed in the second shaft segment. The first shaft segment defines at least two first recesses on a third side facing the coupling element, the at least two first recesses for receiving the at least two first connecting pins. The second shaft segment defines at least two second recesses on a fourth side facing the coupling element, the at least two second recesses for receiving the at least two second connecting pins. The arcing chamber housing defines a transition area between the first and second arcing chambers, the transition area including a support for supporting the support shaft.

According to the present invention the shaft segments, made of plastic and containing the hinged contact bridges, are joined to each other by coupling elements, the interrupter shaft being supported on the explosion chamber housing by the coupling elements. For this purpose, each coupling element contains two tab-shaped parts, which are joined to each other by a bearing shaft and which, on their side facing away from the bearing shaft, support, in each case, at least two connecting pins, which, for joining to the neighboring shaft segments, engage with corresponding recesses in the segments.

The coupling element can be made either of metal or of an electrically non-conductive material having sufficient strength. In order to assure a good torsional stiffness of the interrupter shaft, it has proven to be advantageous if the distance between adjoining connecting pins of each coupling element is greater than the diameter of the bearing shaft.

BRIEF DESCRIPTION OF THE DRAWINGS

Further details and advantages of the present invention will become evident in the discussion below with reference to the drawings, in which:

FIG. 2 shows a perspective view of the interrupter shaft, composed of three shaft segments and three coupling elements, of the circuit breaker depicted in FIG. 1, before assembly; and FIG. 3 shows the interrupter shaft depicted in FIG. 2, after assembly.

DETAILED DESCRIPTION

Figure 1:
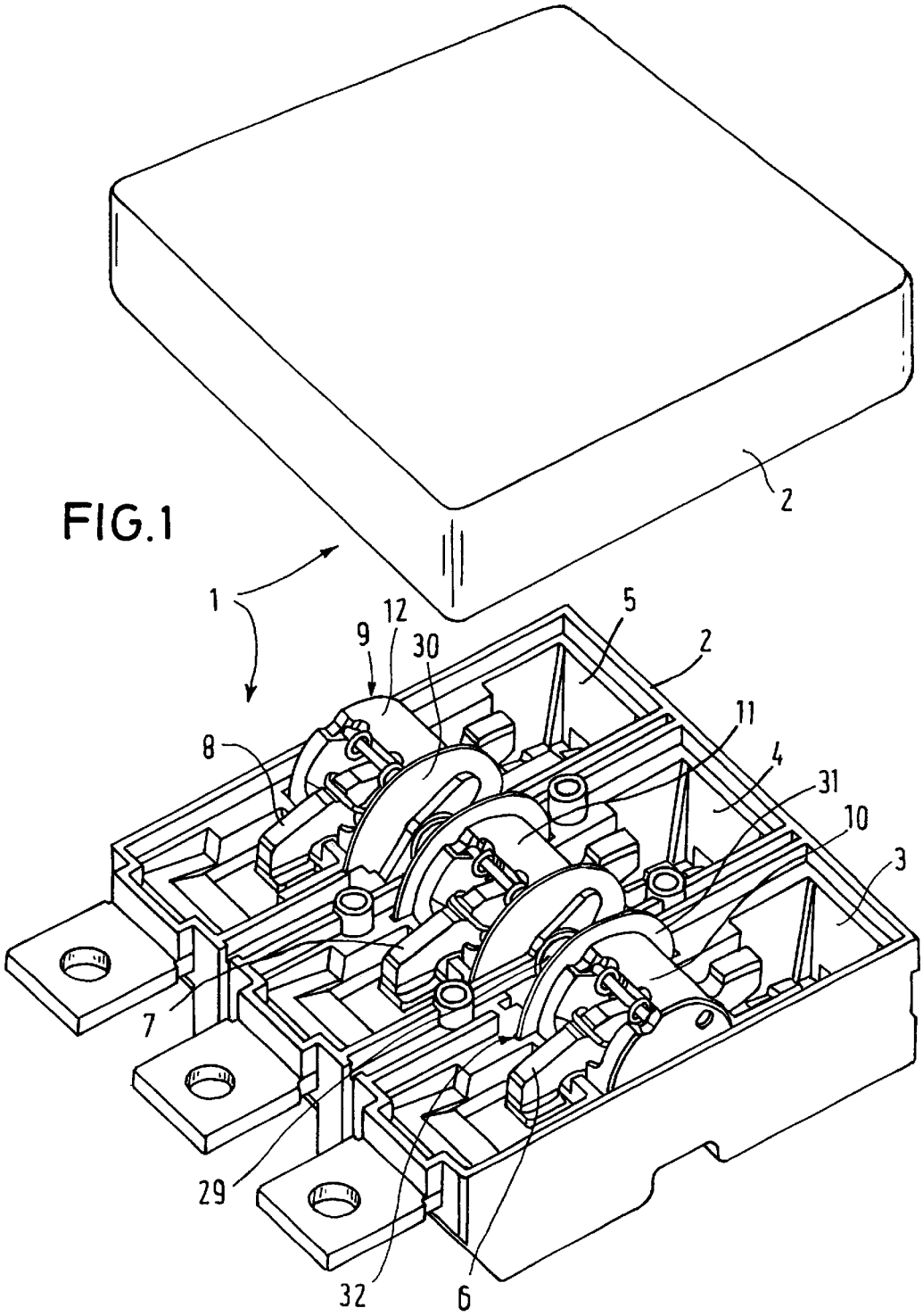
FIG. 1 shows a perspective view of a three-pole circuit breaker according to an embodiment of the present invention with the upper part of the arcing chamber housing removed.

In FIG. 1, a three-pole circuit breaker is designated as 1, the circuit breaker having a plastic arcing chamber housing 2 that has three arcing chambers 3–5, which are substantially similar and are arranged next to each other. Each arcing chamber 3–5 contains a stationary contact arrangement and a contact arrangement that is configured as a hinged contact bridge 6–8 and cooperates in a generally known manner with the stationary contact arrangement (for the design and mode of operation of circuit breakers of this type, see also the above-mentioned European Patent Document No. 0542 636 B1, which is hereby incorporated by reference herein). Contact bridges 6–8 are joined to each other via a common interrupter shaft 9. For this purpose, each contact bridge 6–8 is supported in a hinged manner in a shaft segment 10–12, made of plastic, about a corresponding axis 13 (FIG. 2).

FIGS. 2 and 3 represent interrupter shaft 9 before and after assembly. In this context, shaft segments 10–12 (for reasons of clarity, contact bridges 6–8 are omitted) are joined using identical metal coupling elements 14, 15. The latter, in each case, include two tab-shaped parts 16, 17, which are joined to each other by a bearing shaft 18 and which, on their side facing away from bearing shaft 18, support at least two connecting pins 19, 20 or 21, 22, extending in the axial direction. In this context, distance 23 between adjacent connecting pins 19, 20 or 21, 22 of each coupling element 14, is greater than diameter 24 of bearing shaft 18. Shaft segments 10–12, in each case, on their side facing corresponding coupling element 14, 15, have recesses 25, 26 for receiving connecting bolts 19–22.

Coupling elements 14, 15, in the area between two tab-shaped parts 16, 17, have at least one pin 27, extending in the axial direction, which is fixedly joined to one of two tab-shaped parts 16 or 17 and which has a prescribed distance from other tab-shaped part 17 or 16, respectively, so that on this side a gap-like opening 28 arises. Pin 27 functions to connect interrupter shaft 9 to the undepicted latching mechanism of circuit breaker 1, a usually lever-shaped connecting part (bent lever) of the latching mechanism being inserted into gap-like opening 28 and, as a result of a lateral shifting of pin 27, being inserted into the corresponding recess of the bent lever. The transitional area between adjoining arcing chambers 3–5 is partially configured as support, or bearing, 29 (FIG. 1) for support shaft 18 of coupling element 14, 15 that joins corresponding shaft segments 10–12 (FIG. 2, 3).

As can be seen from FIGS. 2 and 3, in the assembly of interrupter shaft 9, an elastic sealing disk 30 is arranged on connecting pins 19–22 of respective coupling element 14, 15, exterior edge 31 of the sealing disk projecting beyond shaft segments 10–12 and engaging in a groove-shaped recess 32 of arcing chamber housing 2 (FIG. 1). As a result of this measure, the ionized gases generated in arcing chambers 3–5 in response to the production of arcs are prevented from penetrating along interrupter shaft 9 into adjoining arcing chambers 3–5. For the gases as a rule have varying pressures, so that elastic sealing disks 30 in the area of their exterior edges 31 are pressed, in each case, against one of the two side walls of arcing chamber housing 2 in the area of groove-shaped recess 32.

The present invention is not limited to the exemplary embodiment described above. Thus, for example, the circuit breaker according to the present invention can also be composed of four arcing chambers. In this case, the interrupter shaft is composed of four shaft segments, which are joined to each other via three coupling elements, as described above. In addition, the coupling elements, instead of being made of metal, can also be made of an electrically insulating material (e.g., plastic), assuming a sufficient torsional stiffness of the interrupter shaft. Pin 27 for connecting the interrupter shaft to the latching mechanism can also be configured as a continuous pin connecting both tab-shaped parts 16 and 17 to each other without forming a gap-like opening 28. In this case, the bent lever of the latching mechanism is already arranged on the pin in pre-assembly.

What is claimed is:

1. A multipole circuit breaker comprising:

an arcing chamber housing defining a first and a second arcing chamber disposed next to each other and each corresponding to a respective pole of the multipole circuit breaker;

an interrupter shaft common to the respective poles of the multipole circuit breaker, the interrupter shaft defining an axial direction and including first and second shaft segments, the first and second shaft segments including an insulating material;

a coupling element joining the first and second shaft segments, the coupling element including first and second tab-shaped parts joined to each other by a support shaft, the first tab-shaped part supporting at least two first connecting pins on a first side facing away from the support shaft, the second tab-shaped part supporting at least two second connecting pins on a second side facing away from the support shaft, the first and second connecting pins extending in the axial direction;

a first stationary contact arrangement and first hinged contact arrangement disposed in the first arcing chamber, the first hinged contact arrangement cooperating with the first stationary contact arrangement and including a first hinged contact bridge disposed in the first shaft segment; and a second stationary contact arrangement and second hinged contact arrangement disposed in the second arcing chamber, the second hinged contact arrangement cooperating with the second stationary contact arrangement and including a second hinged contact bridge disposed in the second shaft segment; the first shaft segment defining at least two first recesses on a third side facing the coupling element, the at least two first recesses for receiving the at least two first connecting pins, the second shaft segment defining at least two second recesses on a fourth side facing the coupling element, the at least two second recesses for receiving the at least two second connecting pins; the arcing chamber housing defining a transition area between the first and second arcing chambers, the transition area including a support for supporting the support shaft.

2. The multipole circuit breaker as recited in claim 1 wherein the first and second coupling elements include at least one of a metal and an electrically insulating material.

3. The multipole circuit breaker as recited in claim 1 wherein a first distance between the at least two first connecting pins and a second distance between the at least two second connecting pins are each respectively greater than a diameter of the support shaft.

4. The multipole circuit breaker as recited in claim 1 wherein the coupling element includes at least one third pin disposed in an area between the first and second tab-shaped parts and extending in the axial direction, the third pin being fixedly attached to at least one of the first and second tab-shaped parts.

5. The multipole circuit breaker as recited in claim 4 wherein the third pin is fixedly attached to only one of the first and second tab-shaped parts and disposed at a preselected distance from the respective other tab-shaped part.

6. The multipole circuit breaker as recited in claim 1 further comprising at least one first elastic sealing disk disposed on the at least two first connecting pins and at least one second elastic sealing disk disposed on the at least two second connecting pins, a respective exterior edge of each of the at least one first and at least one second elastic sealing disks engaging a respective groove-shaped recess defined by the arcing chamber housing.

* * * * *